US010865016B2

(12) United States Patent
Fisher et al.

(10) Patent No.: US 10,865,016 B2
(45) Date of Patent: Dec. 15, 2020

(54) SQUEEZABLE CONTAINER AND DISPENSER ASSEMBLY AND METHOD OF USE

(71) Applicants: Chad William Fisher, Centennial, CO (US); Amy Linda Fisher, Centennial, CO (US); Riccardo James Tresso, Aurora, CO (US); Thomas Grant Fisher, Greeley, CO (US)

(72) Inventors: Chad William Fisher, Centennial, CO (US); Amy Linda Fisher, Centennial, CO (US); Riccardo James Tresso, Aurora, CO (US); Thomas Grant Fisher, Greeley, CO (US)

(73) Assignee: New Direction Packaging, Centennial, CO (US)

( * ) Notice: Subject to any disclaimer, the term of this patent is extended or adjusted under 35 U.S.C. 154(b) by 0 days.

(21) Appl. No.: 16/057,816

(22) Filed: Aug. 8, 2018

(65) Prior Publication Data

US 2019/0047752 A1 Feb. 14, 2019

Related U.S. Application Data

(60) Provisional application No. 62/605,350, filed on Aug. 9, 2017.

(51) Int. Cl.

| | |
|---|---|
| ***B65D 35/22*** | (2006.01) |
| ***B65D 47/20*** | (2006.01) |
| ***B65D 8/00*** | (2006.01) |
| ***B65D 83/00*** | (2006.01) |

(52) U.S. Cl.

CPC ..... *B65D 35/22* (2013.01); *B65D 11/02* (2013.01); *B65D 47/2031* (2013.01); *B65D 83/0055* (2013.01); *B65D 2209/00* (2013.01)

(58) Field of Classification Search

CPC ..... B65D 35/22; B65D 83/0055; B65D 1/04; B65D 47/2031; B65D 25/52; B65D 2209/00; Y10S 220/916; A47K 10/424; A47K 10/46

USPC ..... 222/92–107, 214; 221/64, 35, 102

See application file for complete search history.

(56) References Cited

U.S. PATENT DOCUMENTS

| | | | | |
|---|---|---|---|---|
| 1,522,246 A * | 1/1925 | Jefferson | ..... | B65D 35/22 222/94 |
| 2,741,559 A | 4/1956 | Banowitz | | |
| 3,592,365 A * | 7/1971 | Schwartzman | .... | B65D 47/2075 222/209 |

(Continued)

*Primary Examiner* — Paul R Durand
*Assistant Examiner* — Robert K Nichols, II
(74) *Attorney, Agent, or Firm* — Bret Adams

(57) ABSTRACT

The present disclosure is directed to a squeezable container having first and second compartments for storing and dispensing a plurality of items. The container may be used for storing food items and remnant food waste in the first or second compartments while keeping them physically separate to prevent mixing of fresh food and waste products. The squeezable container may be made of a resilient, flexible material which retains its original shape while allowing a user to deform the container to access the first and second containers, Apertures in top and bottom caps of the container assembly flexibly deform to allow access to the first and second compartments when the top and bottom caps are squeezed by a user, while retaining food items therein when not squeezed by the user.

13 Claims, 10 Drawing Sheets

(56) References Cited

U.S. PATENT DOCUMENTS

| | | | | |
|---|---|---|---|---|
| 4,078,686 | A | 3/1978 | Karesh | |
| 4,151,910 | A | 5/1979 | Yasur | |
| 4,340,154 | A * | 7/1982 | VanManen | B65D 35/242 222/136 |
| 4,444,324 | A | 4/1984 | Grennel | |
| 4,879,442 | A * | 11/1989 | Giovine | B65D 83/0888 206/233 |
| 5,012,956 | A * | 5/1991 | Stoody | B65D 83/0055 222/206 |
| D323,615 | S | 2/1992 | Carlstrom | |
| 6,062,430 | A | 5/2000 | Fuchs | |
| 6,092,717 | A | 7/2000 | Lowry | |
| 6,196,412 | B1 | 3/2001 | Cattell | |
| 6,264,068 | B1 | 7/2001 | Ours | |
| 6,398,071 | B1 | 6/2002 | Fellers | |
| 6,484,897 | B1 | 11/2002 | Crawley | |
| 6,676,009 | B1 | 1/2004 | Rose | |
| D602,781 | S | 10/2009 | Balkum | |
| 7,866,500 | B1 | 1/2011 | Peggs | |
| 7,882,991 | B2 | 2/2011 | Schecter | |
| 7,946,422 | B1 | 5/2011 | Bjerke | |
| 8,074,841 | B1 | 12/2011 | Craig | |
| 8,225,955 | B2 | 7/2012 | Moskow | |
| 8,302,810 | B2 | 11/2012 | Mulhem | |
| D673,048 | S | 12/2012 | Waite | |
| 8,348,107 | B2 * | 1/2013 | Succar | B65D 47/2018 222/209 |
| 8,752,729 | B2 * | 6/2014 | Maccario | B65D 83/08 221/34 |
| 9,144,642 | B2 * | 9/2015 | Hwang | A61M 5/3205 |
| 9,289,083 | B2 | 3/2016 | Lee | |
| 2002/0155202 | A1 | 10/2002 | Rebhorn | |
| 2005/0115983 | A1 * | 6/2005 | Barr | B65D 81/3211 222/94 |
| 2005/0161424 | A1 | 7/2005 | Hogan | |
| 2006/0226171 | A1 | 10/2006 | Sternberg | |
| 2007/0012701 | A1 | 1/2007 | Amormino | |
| 2007/0187429 | A1 * | 8/2007 | Farahmand | B65D 35/22 222/94 |
| 2009/0057332 | A1 | 3/2009 | Arzola | |
| 2009/0224002 | A1 | 9/2009 | Bakhos | |
| 2010/0193459 | A1 | 8/2010 | Housley | |
| 2015/0158632 | A1 | 6/2015 | Wilhelm | |
| 2017/0050763 | A1 | 2/2017 | Gharibjanians | |
| 2017/0217641 | A1 * | 8/2017 | Genaw, Jr. | B65D 75/52 |
| 2017/0348715 | A1 | 12/2017 | Beer | |

* cited by examiner

SQUEEZABLE CONTAINER AND DISPENSER ASSEMBLY AND METHOD OF USE

CROSS-REFERENCE TO RELATED APPLICATIONS

The present application is a non-provisional of U.S. Provisional Patent Application Ser. No. 62/605,350 titled "SQUEEZABLE TWO CHAMBER VARIABLE VOLUME CONTAINER", filed 9 Aug. 2017, which is incorporated herein as if set out in full.

TECHNICAL FIELD

The technology described herein relates to a flexible, squeezable container and dispenser assembly. In one example, this disclosure is directed to a flexible food container having at least two compartments for storing and dispensing edible food products and storing remnant waste products, such as sunflower seeds and sunflower seed shells. One compartment may be provided for containing unused food products, while another compartment may be provided for accepting food remnants and waste product resulting from consuming at least a portion of the food products. The compartments may be dynamically variable based on the amount of food and waste contained therein. However, other uses are contemplated herein wherein a user of the flexible food container assembly may want to keep multiple products from being in direct contact with each other.

BACKGROUND

Many situations exist where people consume food products that result in a residual material that is inedible. A common example is sunflower seeds and the inedible shells containing the seeds. Other food examples include peanuts, walnuts, pistachios, pitted fruits such as grapes or cherries, and the like. When consuming these foods, the consumer needs a place to discard the residual, inedible material. However, these types of foods are often enjoyed by consumers in locations that don't naturally provide a convenient container for collecting the residual waste material, such as in sports arenas, theaters, or automobiles. Trash cans and other areas for waste disposal may not be immediately or conveniently accessible by the consumer, and as a result consumers may discard the inedible portion of the food products on the ground, requiring cleaning crews to collect this material and resulting in a dirty environment littered with shells and other waste remnants. Typically, these types of snack foods are sold in simple plastic bag containers that only hold the original product, but are not conducive to storing waste products since it will be mixed in with fresh, uneaten food product. For example, a typical consumer would not find it desirable to discard used sunflower or peanut shells in a container having uneaten sunflower seeds or peanuts therein.

Many active consumers also have an occasional need to conveniently carry and transport more than one kind of item without mixing them together. For example, a parent may need to carry two kinds of snacks for their children. In other examples, a pet owner may need to carry pet treats and another item such as a second type of pet food or treat, pet medicine, or a non-consumable material such as pet refuse collection bags.

As the discussion above illustrates, there is a variety of needs around the world that would benefit from a convenient two-chamber, variable volume container which provides a clean and secure way to store remnant waste without mixing it with uneaten, fresh food. The present disclosure, discussed below, is directed at solving this problem by providing the consumer with a way to securely and conveniently carry and access their fresh food products and a way to store the residual waste, all within one novel two chamber variable volume container.

The information included in this Background section of the specification, including any references cited herein and any description or discussion thereof, is included for technical reference purposes only and is not to be regarded subject matter by which the scope of the invention as defined in the claims is to be bound.

SUMMARY

The present disclosure is directed to addressing the deficiencies discussed above in the Background section.

As set forth herein, the present disclosure includes a squeezable container assembly, comprising a main body having a first opening at a first end and a second opening at a second end opposite the first end, the main body comprising a first compartment defined by an inner volume of the main body; a first cap coupled to the main body and comprising a first aperture extending through a first surface of the first cap; second cap removably coupled to the main body and comprising a second aperture extending through a second surface of the second cap; a flexible barrier having an inner volume defining a second compartment; wherein the flexible barrier is coupled to the second end of the main body, and the second cap is removably coupled to the second end of the main body with at least a portion of the flexible barrier disposed between the second cap and the main body; and wherein the first aperture is configured to enable access to the first compartment through the first cap and the second aperture is configured to enable access to the second compartment through the second cap.

As set forth herein, the present disclosure includes a method of storing and dispensing items, comprising providing a squeezable container assembly comprising: a main body having a first opening at a first end and a second opening at a second end opposite the first end, the main body comprising a first compartment defined by an inner volume of the main body; a first cap comprising a first aperture extending through a first surface of the first cap; a second cap comprising a second aperture extending through a second surface of the second cap; a flexible barrier having an inner volume defining a second compartment; coupling the first cap to the first end of the main body; providing a first item in the first compartment; providing the flexible barrier in the second opening and removably coupling the second cap to the second end of the main body, at least a portion of the flexible barrier provided between the second cap and the main body; dispensing a first item from the first compartment through the first aperture in response to a squeezing force on the first cap; receiving a second item in the second compartment by providing the second item through the second aperture of the second cap in response to a squeezing force on the second cap.

DETAILED DESCRIPTION

Figure 1:
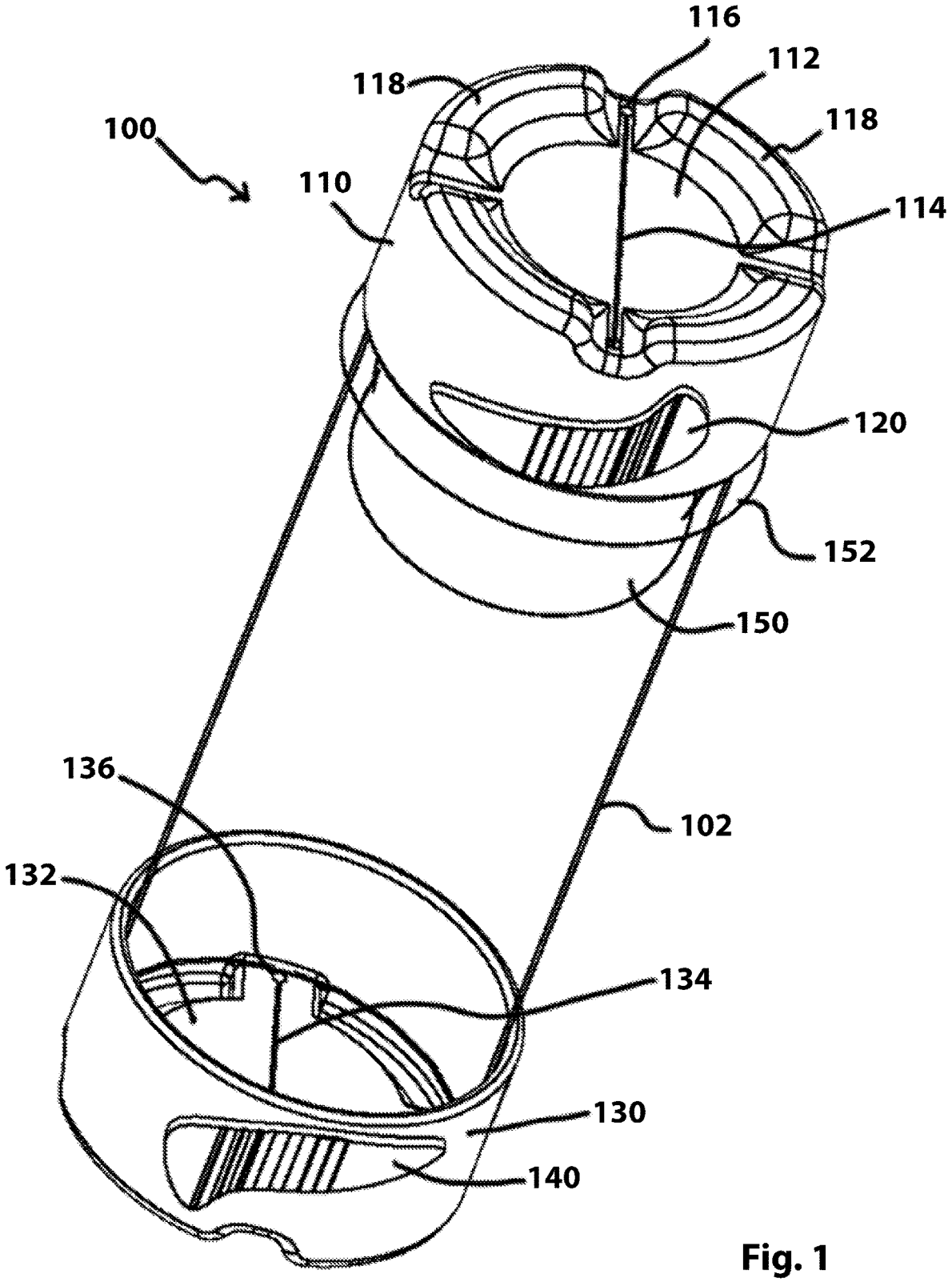
FIG. 1 depicts a perspective view of an assembled squeezable container and dispenser assembly according to a first example.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The description which follows presents several examples of a multi-chamber, squeezable container and dispenser assembly for storing, in some examples, fresh, uneaten food products and the inedible waste remnants of said food. In some examples, the container assembly may be used to store fresh, uneaten sunflower seeds in one compartment and store the inedible shells of sunflower seeds in the separate compartment which provides a physical separation from fresh food compartment. Although discussed below with respect to storing sunflower seeds and other food products, this is merely exemplary of a particular use of the assembly and the present disclosure is not limited to this. The container assembly may be used to store other types of items and other types of food products such as peanuts and peanut shells, fruits and fruit seeds or pits, various different snacks a consumer may want to prevent from mixing (such as, for example, allergenic foods being separated from non-allergenic snacks, gluten free and gluten-containing foods, different snack flavors, or different snack types), and the like. Furthermore, the container according to the present disclosure may be used to store other non-food items which a consumer may want to prevent from mixing, such as different types of medicines to prevent mixing or cross-contaminating, dog treats and dog refuse collection bags, and the like.

Generally speaking, the squeezable container and dispenser assembly of the present disclosure may comprise four main structural components—a cylindrical container body, a top cap, a bottom cap, and a flexible compartment such as, for example, a plastic bag or other flexible barrier. When assembled, the top and bottom caps may allow a user easy access to physically separate compartments, independent from each other (that is, accessing a second compartment without having to first access the first compartment). For example, when assembled, the cylindrical body is inserted into the bottom cap until the body is fully seated into the bottom cap. The first type of item, such as fresh or uneaten food product, may be provided in the inner volume of the cylindrical body which thereby defines a first compartment. The flexible bag may be inserted into the end of the cylindrical body opposite the bottom cap (e.g., on the side of the body where the top cap will be provided). A portion of the bag, on the side of the bag having an opening for accessing the inner volume of the bag, may be wrapped or otherwise secured over the rim of the cylindrical body opening. The inner volume of the flexible bag may define a second compartment which, in some examples, may provide storage for remnant or waste food materials such as, in one example, sunflower seed shells.

The top cap may then be slipped over the bag and cylindrical body, the top cap being pushed down over the body until the cylindrical body is fully seated into the top cap. When seated over the body and bag, the top cap is snug to prevent accidental or unintentional removal from the cylindrical body. That is, the top cap will not simply fall off in any orientation and is securely coupled to the cylindrical body when pressed over the top opening of the body of the container assembly. The snug fit may help prevent the bag from moving relative to the cylindrical body and top cap, and thereby form a variably-sized second compartment in the inner volume of the bag. As the bag is filled with remnant waste products, the volume of the bag may dynamically increase to accommodate the increasing amount of waste therein. Correspondingly, the volume of the first compartment, formed by the inner volume of the cylindrical body, will decrease.

The top and bottom caps may both be provided with apertures for accessing the inner volumes of the second compartment and the first compartment, respectively. In some examples the apertures may be formed as elongated slits across the diameter of the top and bottom caps. The slit may be designed such that it remains substantially "closed" when not in use to prevent food materials or waste products from accidentally or undesirably falling out of the squeezable food container assembly when not in use. However, since in some examples the top and bottom caps are made of a pliable, resilient material, the user may easily access the inner compartments of the squeezable food container simply by applying a squeezing force along the elongated slit to reversibly deform to "open" the container and access either the fresh food product or the disposal compartment for waste products.

With reference now to the figures, examples of the squeezable container and dispenser assembly according the present disclosure will now be discussed.

Figure 2:
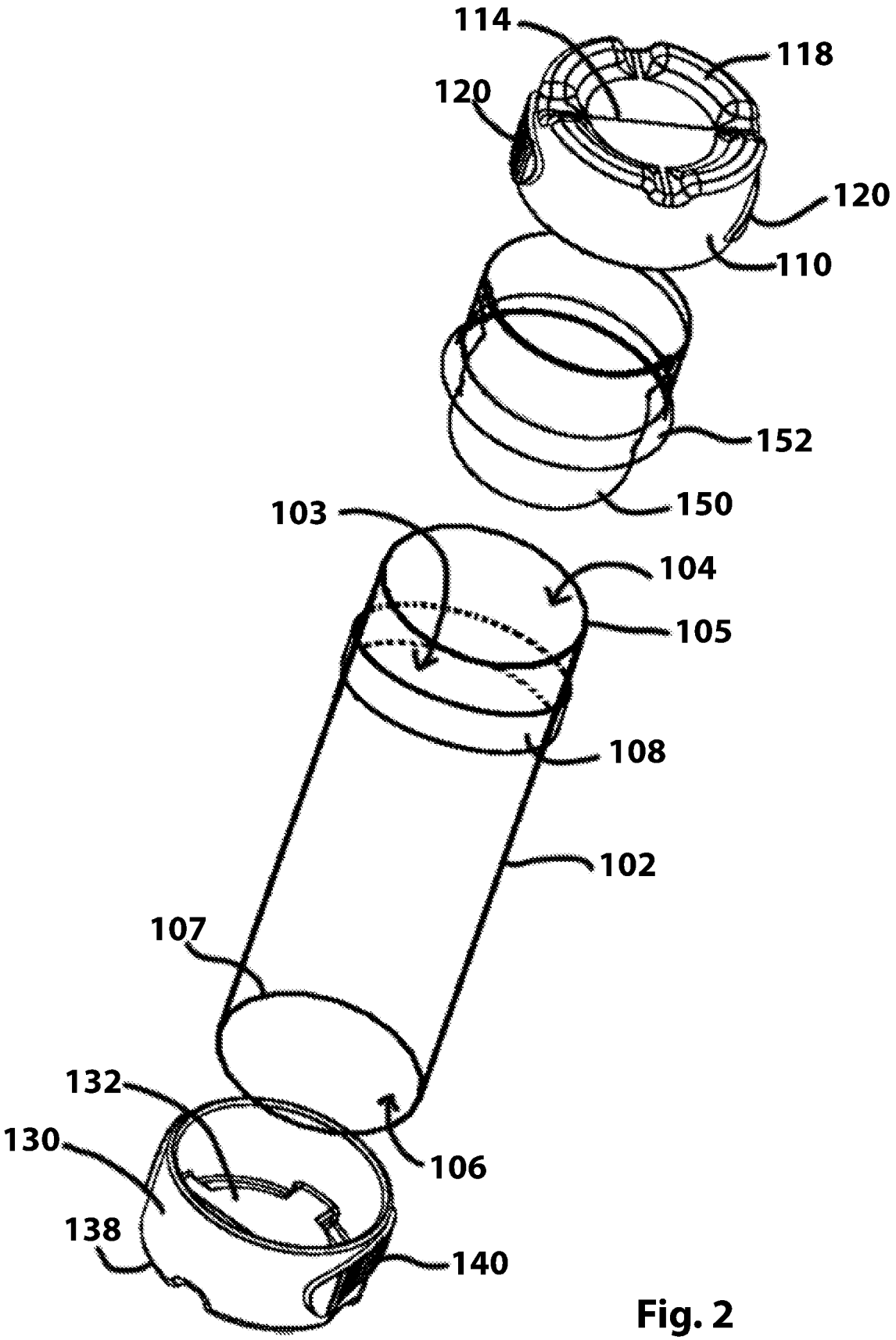
FIG. 2 depicts an exploded perspective view of the assembly of FIG. 1.
Figure 3:
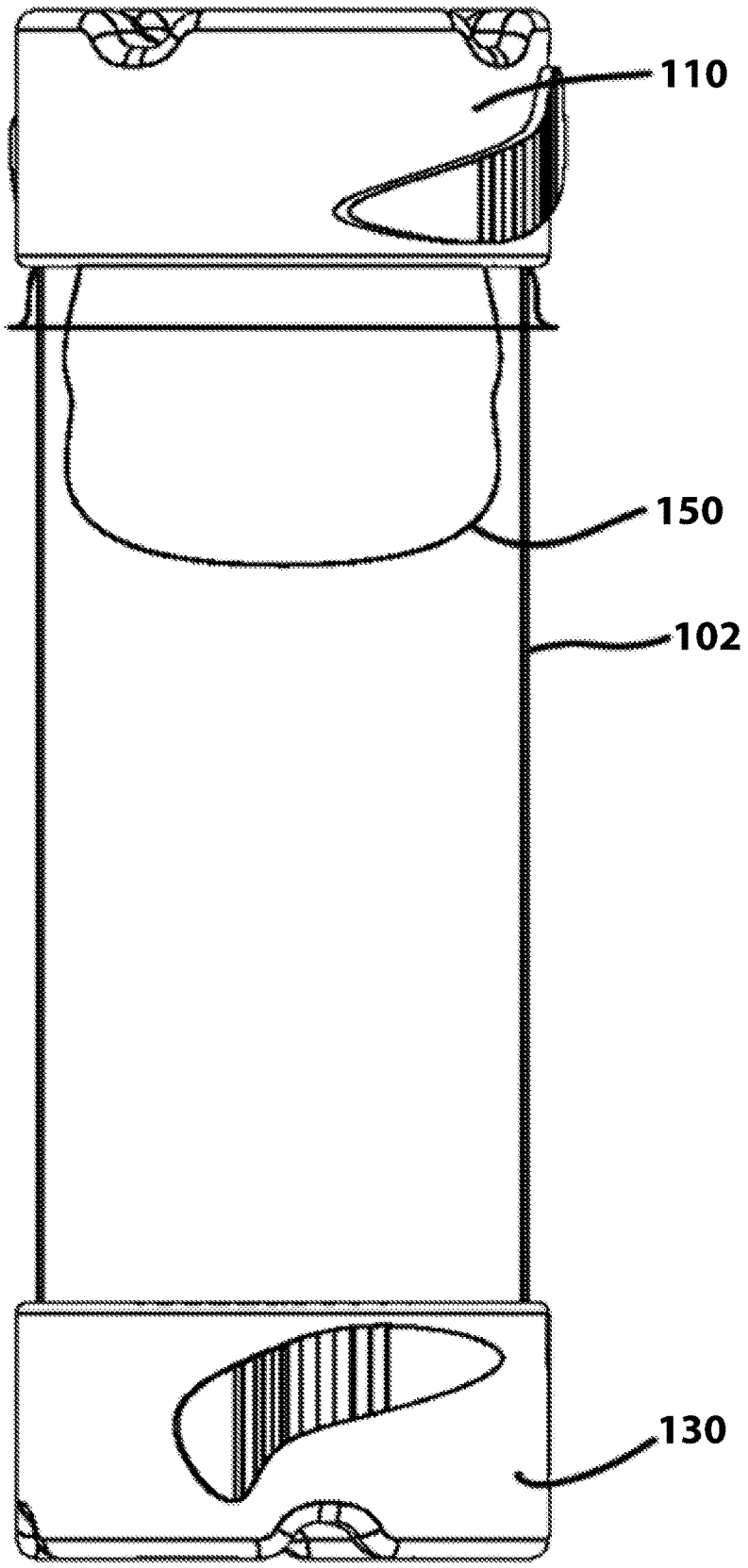
FIG. 3 depicts a front view of the assembly of FIG. 1.

FIG. 1 illustrates a perspective view of an assembled container assembly 100 according to a first example of the present disclosure. FIG. 2 illustrates an exploded perspective view of the container assembly 100 of FIG. 1. A main body 102 of the container assembly 100 may be formed in a substantially elongated cylindrical shape. The main body 102 may in some examples be formed from a transparent resin material, such as a transparent or translucent elastomeric material, such as copolyester. However, other colors and opacities may be used for the main body 102, and other types of plastics, elastomers, or resins may be used. The main body 102 may have substantially any size and shape, including various diameters and heights, and may include various diameters along the height to provide a tapered shape (not shown). However, in a preferred embodiment the main body 102 may be sized and shaped to fit in a common cup holder provided in an automobile, a movie theater, or sports arena. The main body 102 may include a bottom opening 106 having a bottom rim 107 and a top opening 104 having a top rim 105. The bottom opening may be provided to allow items to be dispensed from a first compartment defined by the inner volume 103 through a bottom cap 130, as discussed in more detail below.

In some examples, the dimensions of the main body 102, top cap 110, and bottom cap 130 may be selected to accommodate known volumes of food items which come in standardized or generally-accepted sizes and weights, while still conforming to a standard cup holder size (which range between approximately 2.75" and 3.25" in diameter). For example, some food items may come in 5 oz-6 oz bags whose food items occupy a volume of approximately 35 $in^3$. Accordingly, in this example, to accommodate this volume while constraining the diameter of the main body 102, top cap 110, and bottom cap 130 to 2.75", the main body 102 may be chosen to have a height of 5"-8", with additional height being optionally provided to allow room for the flexible barrier or to provide an empty space between the food items and a flexible barrier. However, it is noted that the main body 102, top cap 110, and bottom cap 130 may be adjusted without departing from the scope of the present disclosure. That is, the diameter of the main body 102, top cap 110, and bottom cap 130 may be increased or decreased, while the height of the main body 102 may be correspondingly increased or decreased according to the formula for the volume of a cylinder (i.e., $V=\pi * r^2 * h$, where V is the volume of the cylinder, r is the radius, and h is the height). In a specific example, the main body 102 may have a radius of 2.75" and a height of 8".

A top cap 110 may be provided with a size and shape corresponding to the dimensions of the main body 102. The top cap 110 may be made of the same material as the main body 102 or may be formed from a different material. In a preferred example, the top cap 110 may be made of a vinyl material, such as PVC and the like. However, the top cap 110 is not limited to this and the top cap 110 may be made of substantially any material which allows for flexible, resilient access to compartments within the main body 102 (e.g., an elastomeric material which returns to its original shape when manually deformed by a user to access the compartment(s)). As illustrated in FIGS. 1 and 2, the top cap 110 may be formed in a shape which corresponds to the shape of the main body 102. The diameter of the top cap 110 may be selected such that it substantially corresponds to the diameter of the main body 102 to provide a snug fit over the end of the rim 105 of the main body 102. In some examples, the resilient, elastic nature of the top cap 110 material may assist in retaining the top cap 110 on the main body 102.

Figure 4:
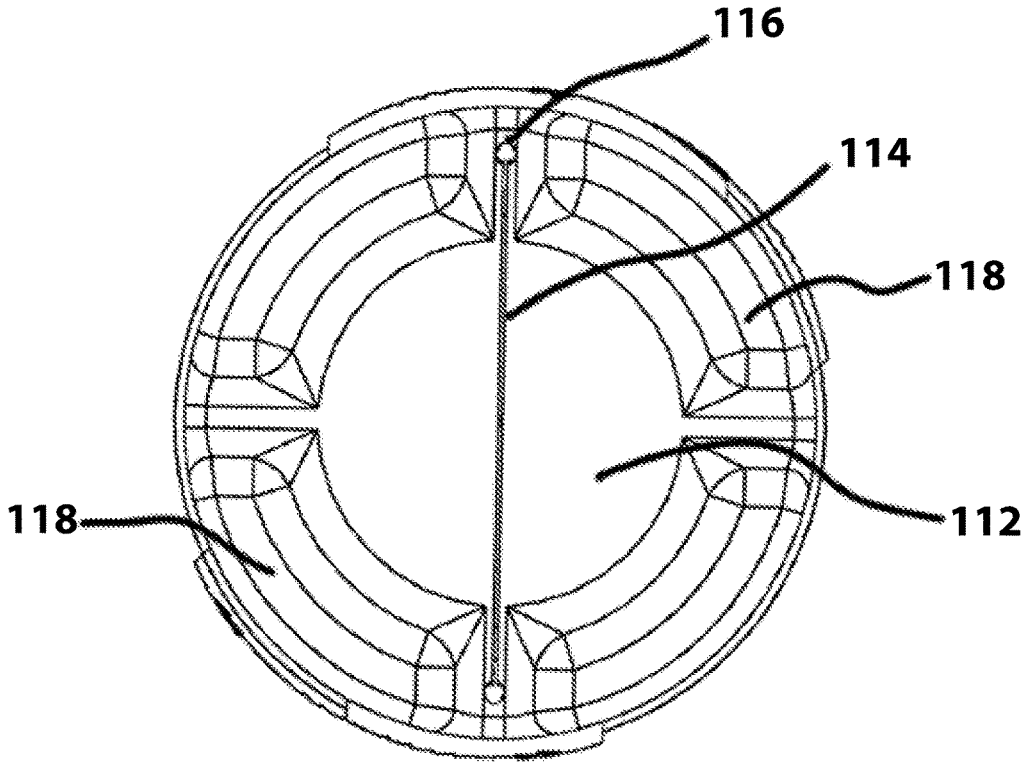
FIG. 4 depicts a top view of the assembly of FIG. 1.
Figure 5:
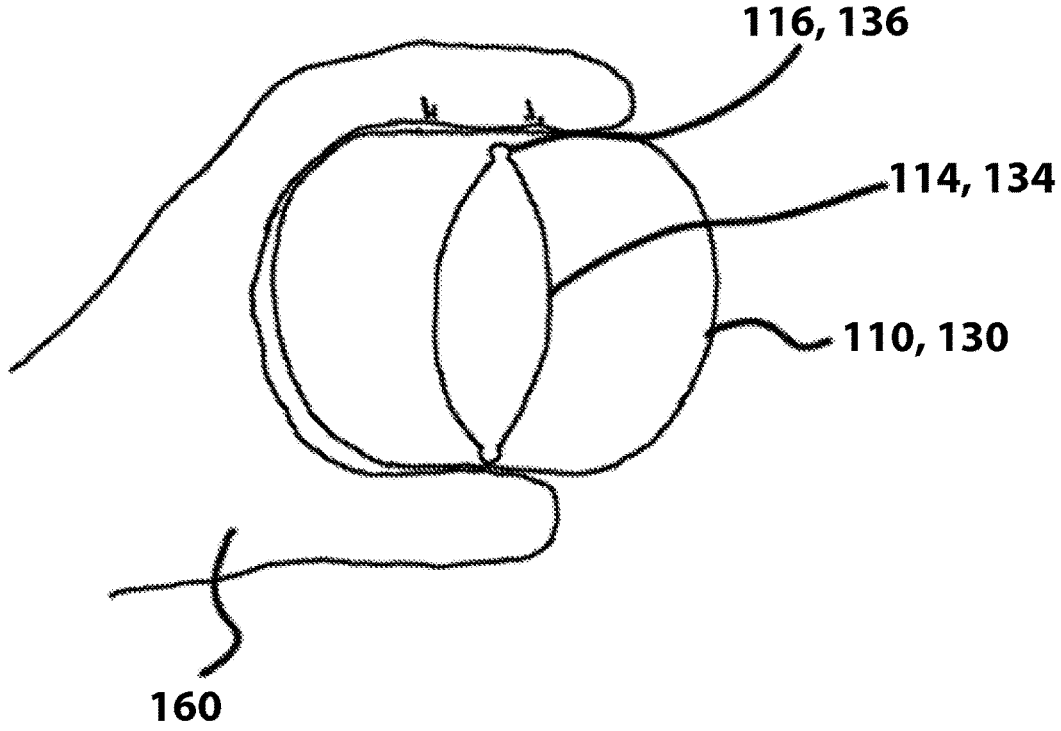
FIG. 5 depicts a user accessing a first or second compartment of the assembly of FIG. 1.
Figure 6:
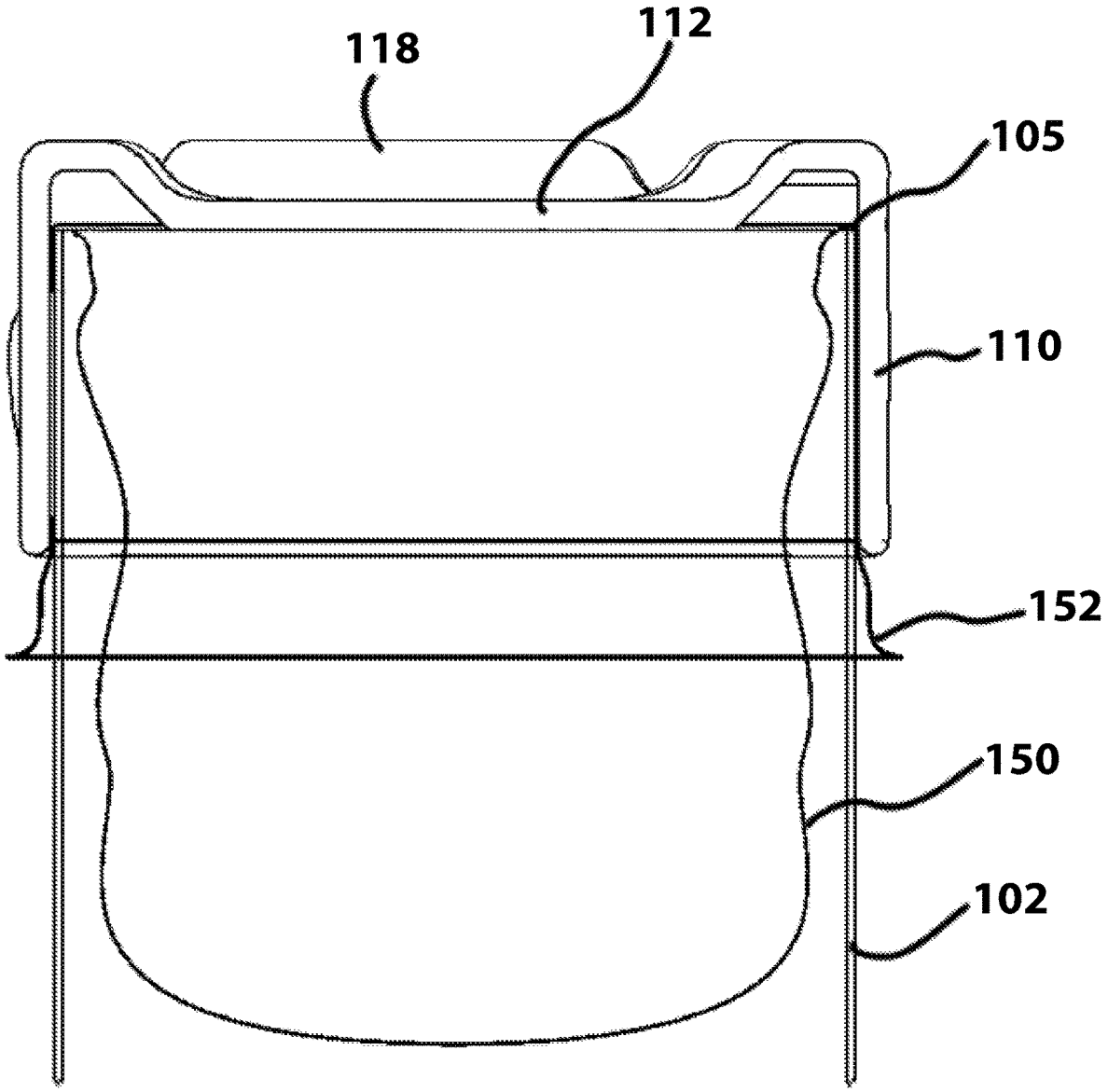
FIG. 6 depicts a cross-sectional side view of a portion of the assembly of FIG. 1.

The top cap 110 may include a top surface 112 having at least one aperture 114 provided therein. In some examples, the aperture 114 may be formed as an elongated slit, as illustrated in FIGS. 1-2, and 4. However, the present disclosure is not limited to this and the aperture 114 may be in substantially any shape, including V-shaped, plus- or cross-shaped, X-shaped, and the like, which allows for easy access to a compartment in the main body 102. In some examples, strain relief features 116 may be provided at opposing ends of the aperture 114 and formed to relieve tearing forces in the top cap 110 material and reduce the chances of ripping when a user accesses an inner compartment of the main body 102. In some examples, the strain relief features 116 may be shaped as round holes at opposing ends of the aperture 114 as illustrated in FIGS. 1, 2, 4, and 5. In other examples, the strain relief features 116 may have a different shape, including an additional deposit of material at each end of the aperture 114 to provide additional reinforcement to the aperture 114 when flexed open (as illustrated in FIG. 5). In other examples, no strain relief features 116 are provided.

The top cap 110 may in some examples include one or more protrusions 118 around a perimeter of the top surface 112. Protrusions 118 may recess the top surface 112 from a resting surface (not shown) when the container assembly 100 is placed thereon. However, it is noted that in some examples no protrusions 118 are provided, and the top surface 112 of the top cap 110 may be substantially planar or smooth, without any protrusions or indentations.

In some examples, the top cap 110 may be provided with an alignment member 120 on an outer surface thereof. The alignment member 120 may be substantially aligned with the aperture 114 so that a user may easily determine where and how best to squeeze the top cap 110 so that the aperture 114 opens (as illustrated in FIG. 5). Alignment members 120 may be provided on opposing sides of the top cap 110 (as seen in FIG. 2) such that a user, without needing to look at the container assembly 100, may tactilely determine the correct orientation for squeezing the top cap 110 to obtain access to the inner compartment. In some examples, the alignment members 120 may be protrusions from the surface of the material, indentations into the material, a set of bumps, an ergonomically-shaped recess conforming to the alignment of a user's finger, and the like. However, the present disclosure is not limited to this, and the alignment members 120 may be substantially any size, shape, and design to allow a user to tactilely locate the axis along which they should apply a squeezing force to open the aperture 114 and access an inner compartment.

Similar to the top cap 110 above, a bottom cap 130 may be provided with a size and shape corresponding to the dimensions of the main body 102. The bottom cap 130 may be made of the same material as the main body 102 or may be formed from a different material. In a preferred example, the bottom cap 130 may be made of a vinyl material, such as PVC and the like. However, the bottom cap 130 is not limited to this and the bottom cap 130 may be made of substantially any material which allows for flexible, resilient access to compartments within the main body 102 (e.g., an elastomeric material which returns to its original shape when manually deformed by a user to access the compartment(s)). As illustrated in FIGS. 1 and 2, the bottom cap 130 may be formed in a shape which corresponds to the shape of the main body 102. The diameter of the bottom cap 130 may be selected such that it substantially corresponds to the diameter of the main body 102 to provide a snug fit over the end of the rim 107 of the main body 102. In some examples, the resilient, elastic nature of the bottom cap 130 material may assist in retaining the bottom cap 130 on the main body 102.

The bottom cap 130 may include a bottom surface 132 having at least one aperture 134 provided therein. In some examples, the aperture 134 may be formed as an elongated slit, as illustrated in FIGS. 1-2, and 4. However, the present disclosure is not limited to this and the aperture 134 may be in substantially any shape, including V-shaped, plus- or cross-shaped, X-shaped, and the like, which allows for easy access to a compartment in the main body 102. In some examples, strain relief features 136 may be provided at opposing ends of the aperture 134 and formed to relieve tearing forces in the bottom cap 130 material and reduce the chances of ripping when a user accesses an inner compartment of the main body 102. In some examples, the strain relief features 136 may be shaped as round holes at opposing ends of the aperture 134 as illustrated in FIGS. 1, 2, 4, and 5. In other examples, the strain relief features 136 may have a different shape, including an additional deposit of material at each end of the aperture 134 to provide additional reinforcement to the aperture 134 when flexed open (as in FIG. 5). In other examples, no strain relief features 136 are provided.

The bottom cap 130 may in some examples include one or more protrusions 138 around a perimeter of the bottom surface 132. Protrusions 138 may recess the bottom surface 132 from a resting surface (not shown) when the container assembly 100 is placed thereon. Furthermore, in some examples the bottom cap 130 may be secured to the main body 102 with an adhesive (not shown) so that the bottom cap 130 does not readily become uncoupled with the main body 102. In some examples, a material bonding adhesive may be used to secure the bottom cap 130 to the main body 102. However, other types of adhesives or adhering processes may be used including pressure sensitive adhesive, UV sensitive or UV-cured adhesive, ultrasonic welding, heat stake, spin welding and the like. However, it is noted that in some examples no protrusions 118 are provided, and the top surface 112 of the top cap 110 may be substantially planar or smooth, without any protrusions or indentations.

In some examples, the bottom cap 130 may be provided with an alignment member 140 on an outer surface thereof. The alignment member 140 may be substantially aligned with the aperture 134 so that a user may easily determine how best to squeeze the bottom cap 130 so that the aperture 134 opens (as illustrated in FIG. 5). Alignment members 140 may be provided on opposing sides of the bottom cap 130 (as seen in FIG. 2) such that a user, without needing to look at the container assembly 100, may tactilely determine the correct orientation for squeezing the bottom cap 130 to obtain access the inner compartment. In some examples, the alignment members 140 may be protrusions from the surface of the material, indentations into the material, a set of bumps, an ergonomically-shaped recess conforming to the alignment of a user's finger, and the like. However, the present disclosure is not limited to this, and the alignment members 140 may be substantially any size, shape, and design to allow a user to tactilely locate the axis along which they should apply a squeezing force to open the aperture 134 and access an inner compartment.

As illustrated in FIG. 2, a flexible barrier 150 may be provided in the opening 104 of the main body 102. The flexible barrier 150 may, in some examples, be a plastic bag provided in the opening 104. The inner volume 151 of the flexible barrier 150 may define a second compartment of the container assembly 100. As illustrated in FIGS. 1-3 and 6, the flexible barrier 150 may be partially inserted into the opening 104 of the main body 102. A portion 152 of the flexible barrier 150 may be draped or cuffed over the rim 105 of the main body 102 such that a portion of the flexible barrier 150 may be secured or captured between the top cap 110 and the main body 102, as illustrated in the cross-sectional view of FIG. 6. The top cap 110 may act to prevent the flexible barrier 150 from moving relative to the main body 102 when the top cap 110 is coupled to the main body 102 with the flexible barrier 150 therebetween.

In some examples, a retention member 108 may be provided around an exterior of the main body 102 corresponding to a location where the flexible barrier 150 and top cap 110 are in contact with the main body 102. The retention member 108 may act as an additional frictional or obstructive force to reduce the potential of the flexible barrier 150 from sliding relative to the main body 102 and top cap 110. In some examples, the retention member 108 may be a tactile piece of label stock, friction tape or cured adhesive adhered to the outer surface of the main body 102.

As illustrated in FIGS. 2 and 7, an inner volume 103 of the main body 102 may define a first compartment while an inner volume 151 of the flexible barrier 150 may define a second compartment. As discussed above, and illustrated in FIG. 5, to access the inner volume 103 or inner volume 151, a user 160 need only to squeeze the top cap 110 or bottom cap 130 along the aperture 114, 134, respectively, to access the respective compartments. When a user 160 is finished accessing the first or second compartments, and releases the top cap 110 or bottom cap 130, the apertures 114, 134 will resiliently close to prevent items stored in the compartments from inadvertently falling out of the container assembly 100.

Figure 7A:
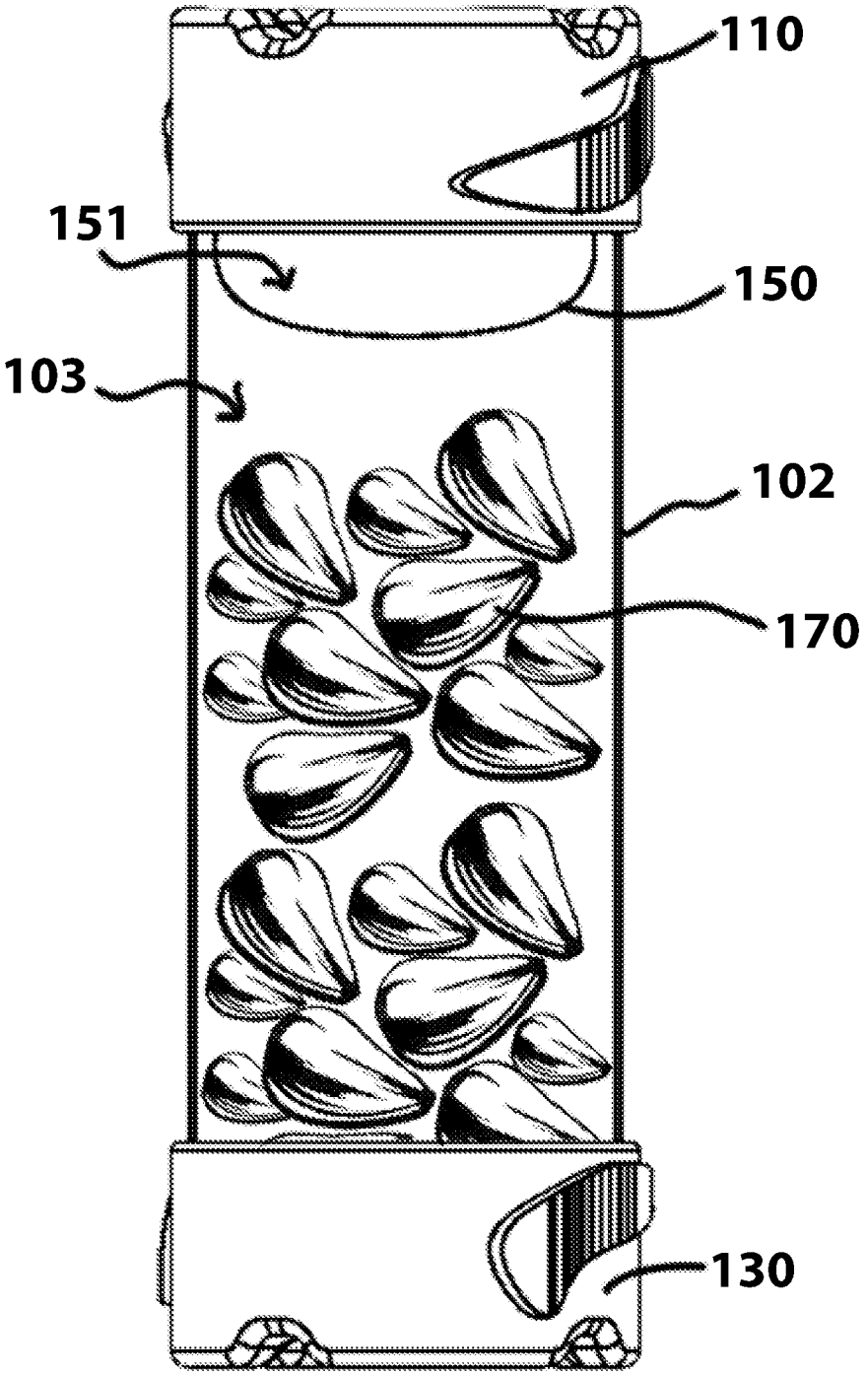
FIGS. 7A-7C depict an exemplary use of the assembly of FIG. 1.
Figure 7B:
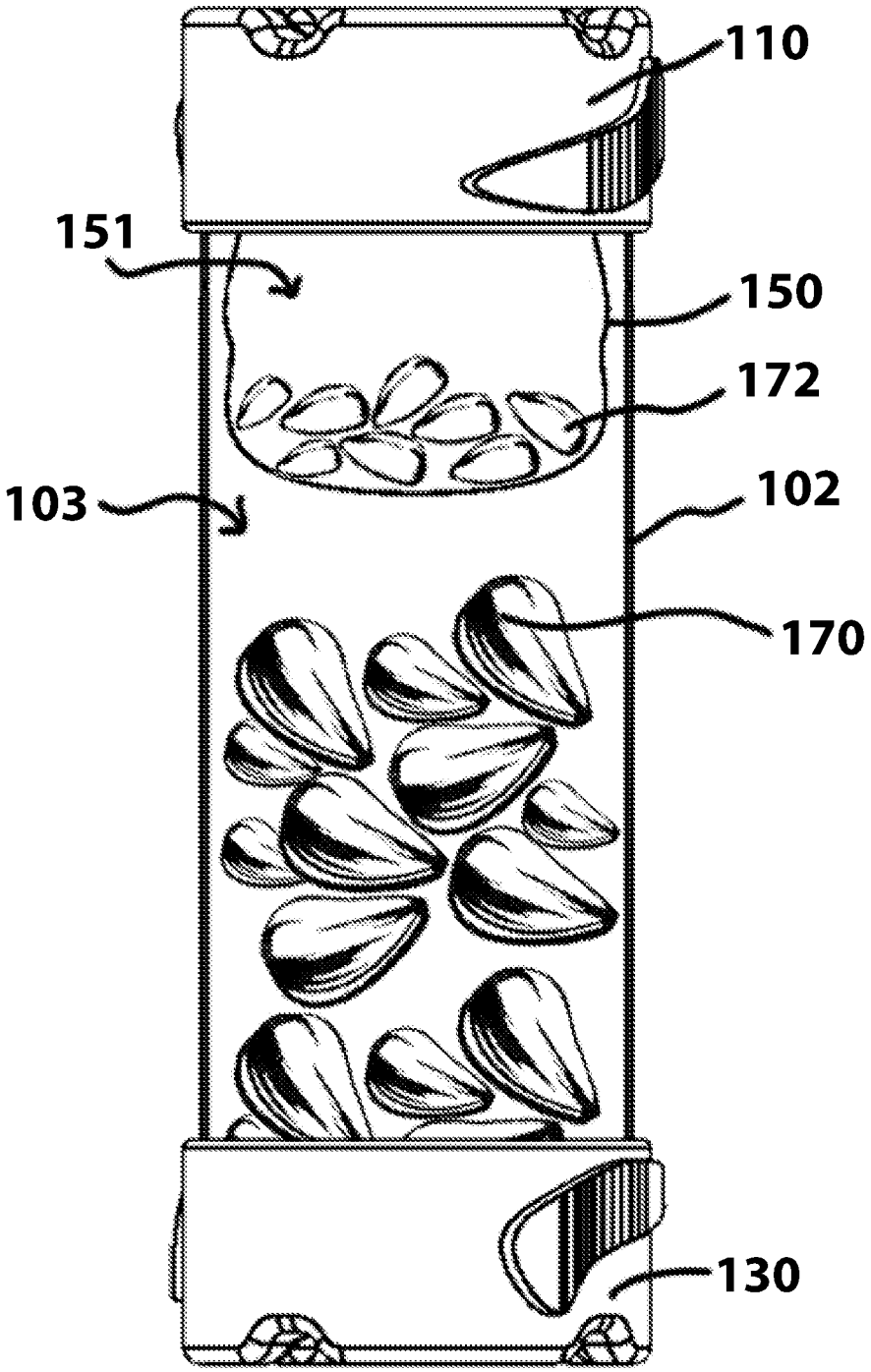
Figure 7C:
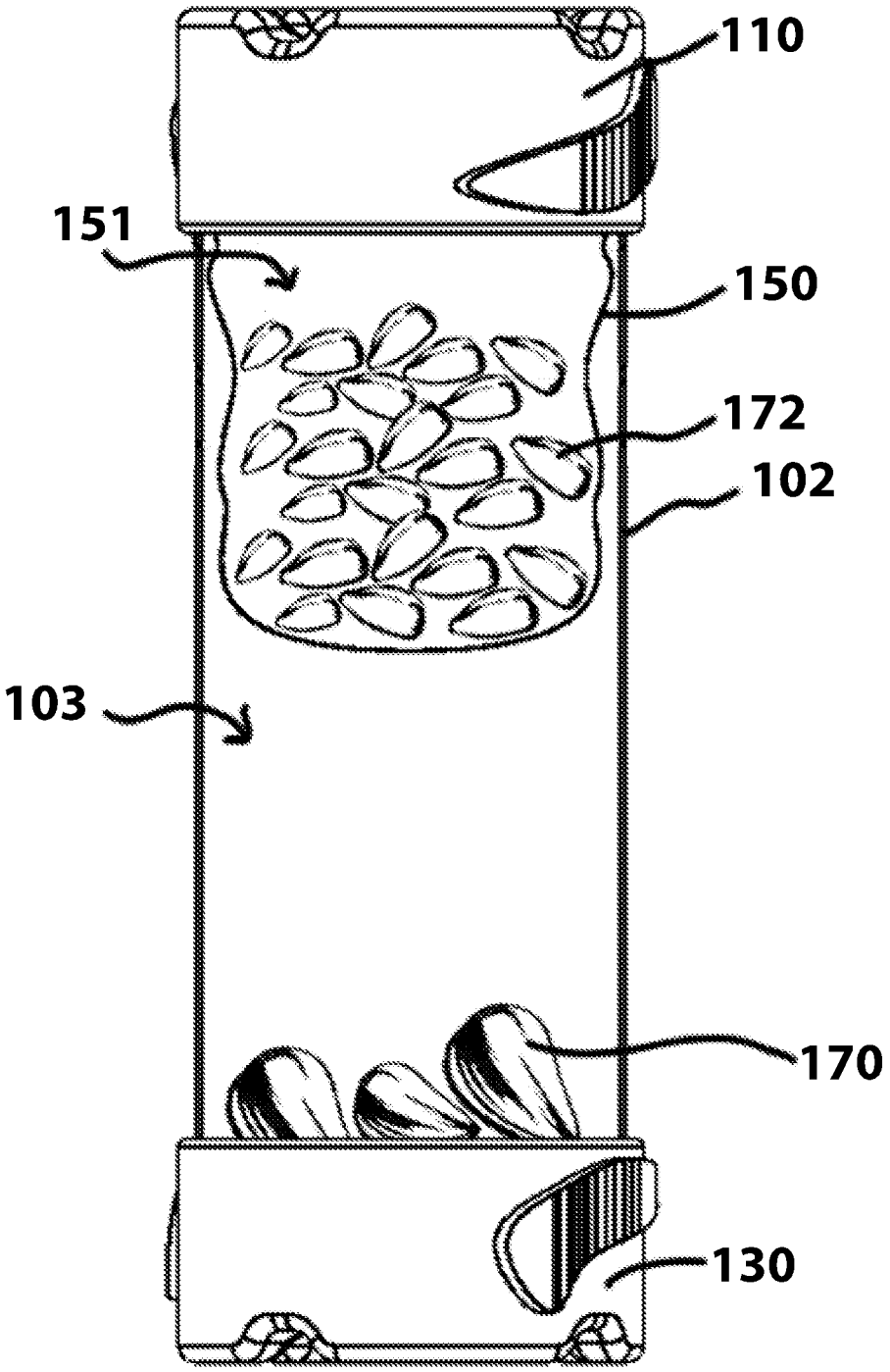

In a particular, non-limiting example, FIGS. 7A-7C illustrate an exemplary use of the container assembly 100 of the present disclosure. As illustrated in the example of FIGS. 7A-7C, uneaten sunflower seeds 170 may be stored in the first compartment 103 of the main body. They may be physically separated from the second compartment 151 by the flexible barrier 150, such as a plastic bag and the like. As illustrated in FIG. 7A, the first compartment 103 is relatively large to accept a large volume of uneaten food items, such as sunflower seeds 170. The second compartment 151 is correspondingly smaller as no waste material is currently stored therein. In FIG. 7B, as a user 160 consumes the sunflower seeds 170, leftover shells 172 may be disposed in the second compartment 151 formed by the flexible barrier 150. As illustrated in FIG. 7B, the volume of the second compartment 151 becomes larger as more sunflower seed shells 172 are stored therein, while the volume of the first compartment 103 is correspondingly smaller. That is, the flexible barrier 150 may deform to increase the volume of the second compartment 151 as more waste material, such as shells 172, is placed therein. FIG. 7C further illustrates the dynamic and variable volume of the first and second compartments 103, 151 as a user 160 consumes the sunflower seeds. This variable volume of the compartments 103, 151 allows for more fresh food items, such as sunflower seeds 170, to be stored in the container assembly 100, up to the entire inner volume of the main body 102, and as a user 160 consumes the sunflower seeds 170 (or other food item), the first compartment 103 shrinks while the second compartment 151 grows in size.

Figure 8:
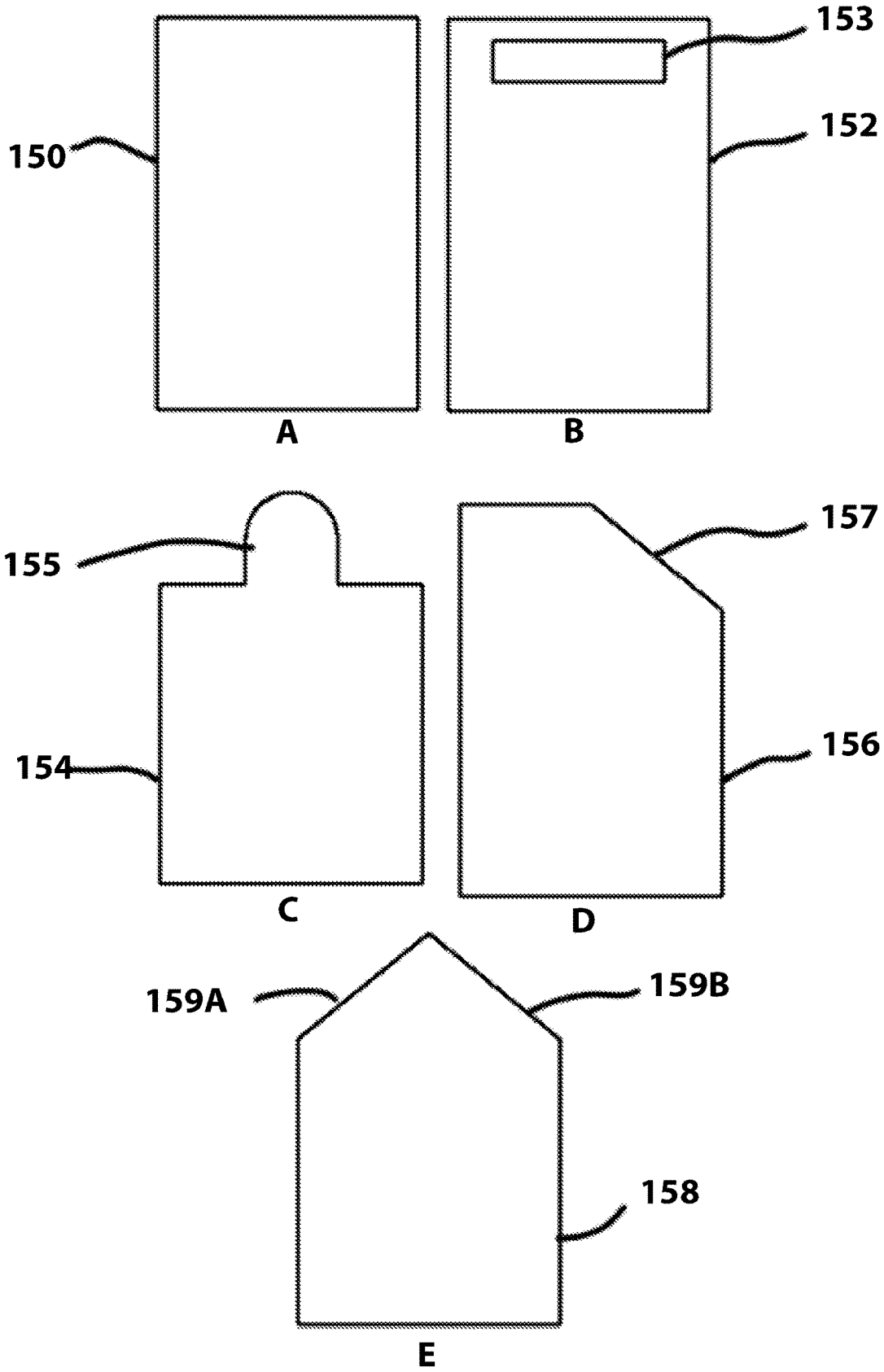
FIG. 8 depicts various flexible barriers for use with the assembly of FIG. 1.

FIG. 8 illustrates various flexible barriers for use with the container assembly 100 discussed above. FIG. 8A illustrates the flexible barrier 150 as discussed above. FIG. 8B illustrates a flexible barrier 152 having an aperture 153 cut or stamped therein. This aperture may allow for more contact between the top cap 110 and the main body 102, which may in some examples reduce the ability of the flexible barrier 152 to slip relative to the main body 102 and top cap 110. Similarly, FIG. 8C illustrates a flexible barrier 154 with a tongue member 155 protruding from an upper end. FIG. 8D illustrates a flexible barrier 156 with a diagonal cut 157 provided therein to increase the contact surface between the top cap 110 and main body 102. Similarly, FIG. 8E illustrates a flexible barrier 158 with a diagonal cut 159A and 159B provided therein to increase the contact surface between the top cap 110 and main body 102. Each of the flexible barriers 150, 152, 154, 156, 158 may be formed from substantially the same material. In some examples, the flexible barriers may be formed from a plastic or other resin. In other examples, the flexible barriers may be formed from a biodegradable material such as cornstarch, which may further increase the frictional contact between the top cap 110 and main body 102, while advantageously being biodegradable.

Figure 9:
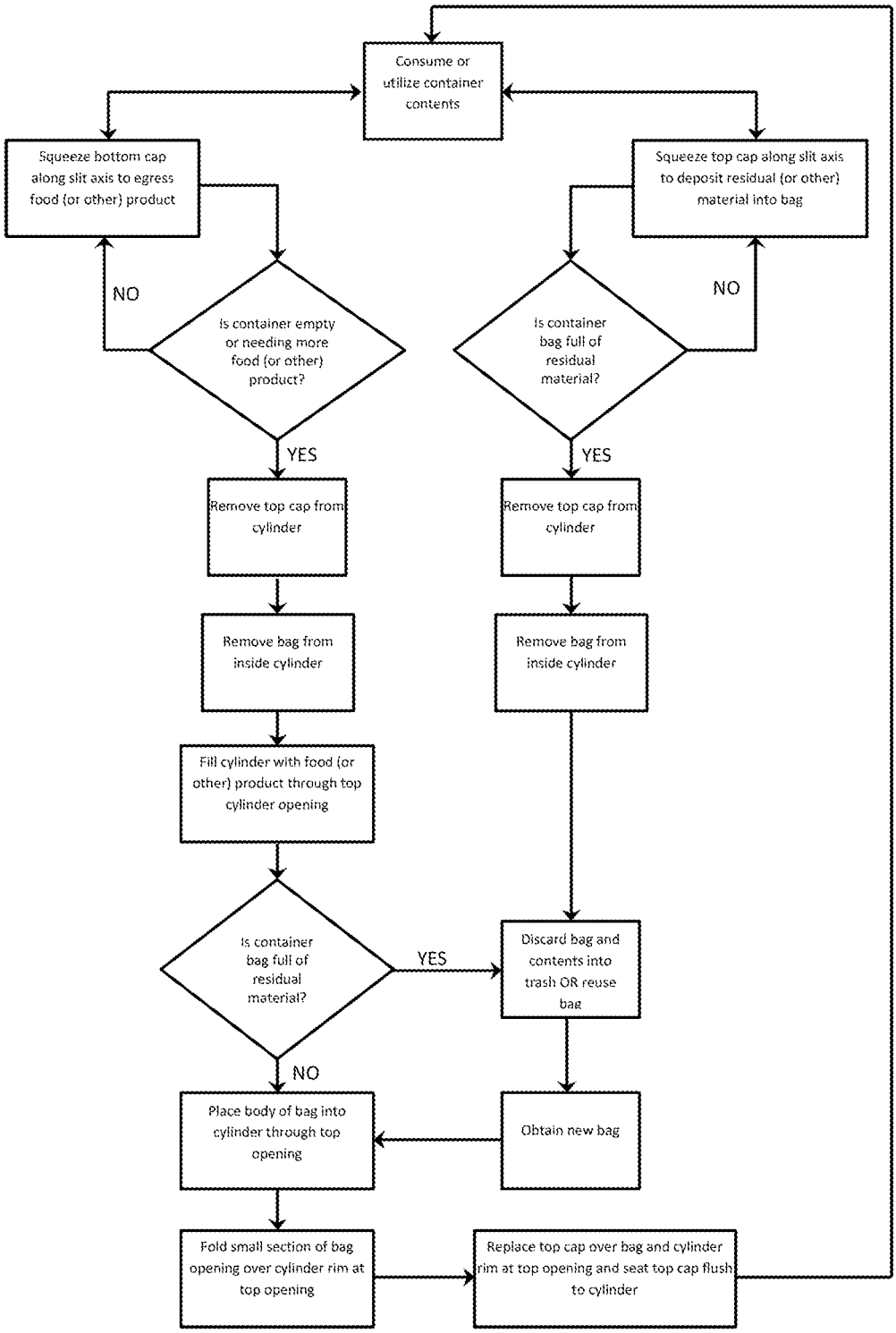
FIG. 9 depicts an exemplary operational flow for using the assembly of FIG. 1.

FIG. 9 is a flowchart of the general methodology for a consumer using the squeezable two chamber variable volume container. FIGS. 5 and 7A-7C illustrate the container assembly 100 in use. The food product 170 (or other material), is accessed by squeezing the bottom cap 130 and forcing aperture 134 to an open condition as shown in FIG. 5. Residual, inedible (or other) material 172 is deposited into the flexible barrier 150 by squeezing the top cap 110 and forcing aperture 114 to an open condition as shown in FIG. 5.

As the food product 170 is consumed, the volume of the food product 170 is decreased, as shown in FIGS. 7B-7C. Correspondingly, the volume available for the flexible barrier 150 and residual food items 172 (or other material) increases as shown in FIGS. 7B-7C.

The consumer or user 160 of the container follows the general methodology shown in FIG. 9 to consume food product, dispose of inedible residual or waste material, add more food product to the container, and/or remove the residual material waste.

It is noted that the materials for the main body 102, top cap 110, bottom cap 130, and flexible barriers 150, 152, 154, 156, 158 may all be made from FDA-approved material to ensure they are safe for use with food products.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A squeezable container assembly for containing edible food products and inedible waste of said food products, comprising:

a main body having a first opening at a first end and a second opening at a second end opposite the first end, the main body comprising a first compartment formed by an inner volume of the main body;

a first cap coupled to the main body and comprising a first aperture extending through a first surface of the first cap;

a second cap removably coupled to the main body and comprising a second aperture extending through a second surface of the second cap;

a flexible barrier having an inner volume defining a second compartment;

wherein the flexible barrier is coupled to the second end of the main body, and the second cap is removably coupled to the second, end of the main body with at least a portion of the flexible barrier disposed between the second cap and the main body;

wherein the first aperture is configured to enable access to the first compartment through the first cap and the second aperture is configured to enable access to the second compartment through the second cap; and wherein the first compartment and second compartment are variable in volume such that as the edible food products are dispensed from the first compartment and inedible waste is deposited into the second compartment, a volume of the second compartment increases, a volume of the first compartment decreases.

2. The squeezable container assembly of claim 1, wherein the first compartment is configured to store a first item and the second compartment is configured to store a second item, the first and second items physically separated by the flexible barrier.

3. The squeezable container assembly of claim 2, wherein the first item is a fresh food item, and the second item is a waste product of the fresh food item.

4. The squeezable container assembly of claim 3, wherein the first item is a dry food item selected from the group comprising sunflower seeds and peanuts, and the second item is an inedible shell of the sunflower seeds or the peanuts.

5. The squeezable container assembly of claim 1, wherein the main body, the top cap, and the bottom cap are, made of a flexible, resilient material capable of returning to the original shape after being elastically deformed.

6. The squeezable container assembly of claim 1, wherein die first aperture and the second aperture are elongated slits provided in the first surface and second surface, respectively.

7. The squeezable container assembly of claim 6, wherein the first cap and second cap each comprise at least one alignment member.

8. The squeezable container assembly of claim 7, wherein the elongated slit of the first cap and second cap each extend from a first position to a second position on the first cap and second cap, respectively, and wherein the at least one alignment member is provided proximal to the first position and/or the second position.

9. The squeezable container assembly of claim 1, further comprising a retention member provided around the main body proximal to the second cap, the retention member configured to retain the flexible barrier between the main body and the second cap.

10. The squeezable container assembly of claim 1, wherein the flexible barrier is coupled to the second end of the main body, at least a portion of the second cap remains in direct contact with the main body.

11. The squeezable container assembly of claim 1, wherein the flexible barrier comprises one or more contact areas selected from the group comprising one or more apertures extending through the portion, one or more tongue members provided in the portion, one or more tapered ends provided in the portion, and/or one or more diagonal cuts provided in the portion, wherein the contact areas are configured to allow physical contact between the main body and the top cap when the portion of the flexible bag is disposed between the main body and the second cap.

12. A method of storing and dispensing edible items, comprising:

providing a squeezable container assembly comprising:

a main body having a first opening at a first end and a second opening at a second end opposite the first end, the main body comprising a first compartment formed by an inner volume of the main body;

a first cap comprising a first aperture extending through a first surface of the first Cap;

a second cap comprising a second aperture extending through a second surface of the second cap;

a flexible barrier having an inner volume defining a second compartment;

coupling the first cap to the first end of the main body;

providing an edible food item in the first compartment;

providing the flexible barrier in the second opening and removably coupling the second cap to the second end of the main body, at least a portion of the flexible barrier provided between the second cap and the main body;

dispensing one or more edible food items from the first compartment through the first aperture in response to a squeezing force on the first cap;

receiving inedible material in the second compartment by providing the second item through the second aperture of the second cap in response to a squeezing force on the second cap;

wherein the first compartment and second compartment are variable in volume such that as edible food products are dispensed from the first compartment and inedible material is deposited into the second compartment, a volume of the second compartment increases, a volume of the first compartment decreases.

13. The method of claim 12, wherein the first item is selected from a group comprising Sunflower seeds and peanuts, and the second item is an inedible shell of the sunflower seeds or the peanuts.

* * * * *